United States Patent [19]

Dusenbury et al.

[11] 4,415,331

[45] Nov. 15, 1983

[54] PROCESS FOR CHEMICALLY SCULPTURING WOOL PILE FABRICS

[75] Inventors: Joseph H. Dusenbury; Daniel T. McBride, both of Spartanburg, S.C.

[73] Assignee: Milliken Research Corporation, Spartanburg, S.C.

[21] Appl. No.: 357,008

[22] Filed: Mar. 11, 1982

[51] Int. Cl.[3] ..... D06Q 1/02

[52] U.S. Cl. ..... 8/114.6; 8/128 R

[58] Field of Search ..... 156/654, 655, 668, 277; 8/114.6, 115, 128 R

[56] References Cited

U.S. PATENT DOCUMENTS

| | | | |
|---|---|---|---|
| 2,499,987 | 3/1950 | Clapham et al. | 8/128 R |
| 2,701,178 | 2/1955 | Fell | 8/128 R |
| 3,236,585 | 2/1966 | Chesner et al. | 8/128 R |
| 3,994,681 | 11/1976 | Hanekom et al. | 8/128 R |
| 4,255,231 | 3/1981 | Boba et al. | 156/668 |
| 4,353,706 | 10/1982 | Burns et al. | 8/114.6 |

FOREIGN PATENT DOCUMENTS

| | | | |
|---|---|---|---|
| 787288 | 6/1968 | Canada | 8/128 R |
| 787289 | 6/1968 | Canada | 8/128 R |

*Primary Examiner*—Jerome W. Massie

*Attorney, Agent, or Firm*—H. William Petry; Terry T. Moyer

[57] ABSTRACT

A process for sculpturing a pile fabric having pile fibers made from wool, or wool-nylon blends, which comprises: treating said wool by oxidizing its sulfide bonds accompanied by acid hydrolysis; contacting the pile surface of said fabric with a fiber degrading composition, said composition comprising a fiber degrading agent in a concentration sufficient to reduce the tensile strength of the fibers of the pile in the selected areas so that said pile fibers may be removed by mechanical action; said fiber degrading agent being an aromatic sulfonic acid having a $pK_a$ value of less than about 2; said fiber degrading composition further containing a diluent for said fiber degrading agent, heating said pile fabric to a temperature sufficient to cause the tensile strength of said fibers of said pile in the selected areas to be reduced sufficiently so that said fibers may be removed by mechanical means, but said temperature being low enough so as not to result in complete destruction of the fiber integrity prior to removal by mechanical means; and removing said degraded portion of said pile fibers by mechanical means to provide a sculptured pile fabric.

3 Claims, No Drawings

PROCESS FOR CHEMICALLY SCULPTURING WOOL PILE FABRICS

The present invention relates to a process for sculpturing wool pile fabrics. More particularly the present invention relates to a process for sculpturing wool pile fabrics wherein the cystine disulfide bonds of the wool fibers are oxidized, the proteinic amide bonds are hydrolyzed under acidic conditions and then the tensile strength of the wool fibers of the portions of the pile desired to be sculptured is reduced so that the pile may be removed in those selected areas by mechanical means.

The embossing of pile fabrics has been accomplished in the past by means of a variety of techniques. An early technique involved the use of a heated, engraved embossing roll or plate to create the design desired in raised relief on the surface of the fabric. Later methods of embossing pile fabrics employed chemical techniques such as those disclosed in U.S. Pat. No. 2,020,698 which involves the localized treatment of a cellulose yarn with an alkali or alkaline earth salt saponifying agent such as sodium hydroxide, or sodium carbonate.

Other sculpturing methods employing shrinking of the fibers by chemical means are known. It has thus been suggested, for instance, that pile fabrics, made from nylon carpet fibers having a textured or embossed surface, may be prepared by selectively contacting the surface of the carpet with a chemical fiber shrinking agent therefor, the shrinking serving to reduce the height of the pile in the treated areas, thereby creating a textured surface. In this regard, U.S. Pat. No. 3,849,157 discloses the use of an embossing agent blended into a liquid base vehicle containing a metal halide such as zinc chloride and an acid such as acetic acid which causes shrinkage of the pile fibers in the selected areas where it is applied. A similar process for providing an embossed effect on nylon pile fabric is disclosed in U.S. Pat. No. 3,849,158 where an embossing agent such as benzotriazole, hydroxyacetic acid, or formic acid, etc. causes a sculptured effect when it is applied by shrinking selected areas.

U.S. Pat. No. 3,856,598 discloses a process for producing texturized effects in a three component laminate which comprises applying a shrinking agent to the fibrous component of the laminate, drying the fabric and washing the fabric. The patent discloses many types of shrinking agents which may be used depending upon the nature of the components of the laminate. With regard to nylon, the shrinking agent is disclosed to be an acidic material having a dissociation constant greater than about $2\times10^{-5}$, such as mono and polybasic inorganic acids and organic acids, such as acylic acid, formic acid, monochloroacetic acid, o-chlorobenzoic acid and even sulfonic acids, such as p-toluene sulfonic acid, benzene sulfonic acid, and phenols, such as m-cresol, and p-chlorophenol (col. 4, lines 47–59). The patent emphasizes that the acid should be selected so as to minimize fiber degradation (col. 4, lines 60–64).

A second category of what may conveniently be termed "chemical sculpturing methods" employs complete dissolution of the pile fibers which come into contact with the applied chemical-sculpturing agent. Exemplary of what may be called the chemical fiber-dissolving type of sculpturing are the processes disclosed in U.S. Pat. Nos. 3,567,548 and 3,830,683. In the former patent a process is disclosed for the sculpturing of pile fibers, e.g., acrylic and polyester, by depositing polar solvent-containing solutions for the fiber in the pile, such as dimethyl formamide and dimethyl sulfoxide, having a viscosity of 500 to 1000 cps. According to the process a deep contour is provided in the fabric by totally dissolving portions of the pile fabric to which the solution has been applied. Similarly U.S. Pat. No. 3,830,683 discloses a process for embossing or sculpturing a tufted pile fabric printed with a decorative pattern. According to the disclosure the ink formulation used for printing the fabric contains a solvent for the carpet and the printing step is immediately followed by a steaming step, resulting in a combination of fiber shrinkage and dissolving to produce an embossed effect. The carpet may then be washed and dried to provide a carpet product having an embossed design.

More recent developments in the area of chemical sculpturing of pile fabrics have involved neither shrinking nor pile destruction of the pile fibers. Instead, the pile surface of the fabric is treated with a fiber degrading agent in a concentration sufficient to reduce the tensile strength of the fibers of the pile in the selected areas so that the pile fibers may be removed by mechanical action. In this regard, U.S. Pat. No. 4,255,231 to Boba et al. discloses a process for producing an etched effect on nylon pile fabric by applying to selected areas a chemical etching agent in a paste vehicle. The agent is allowed to remain in contact with a top portion of the fibers extending downward from the top of the pile in an atmosphere of steam for a period of time sufficient to effect decomposition of the pile to the desired depth whereupon the destroyed pile may be removed by washing or brushing from the fabric. Because the etching composition of Boba et al. is in the form of a paste it is limited as to the application apparatus that may be used. Typically, a screen printer may be employed. U.S. patent application Ser. No. 141,036 to Burns et al., Apr. 17, 1980, discloses a composition for sculpturing nylon and other pile fabrics by means of a fiber degrading composition having a lower viscosity, typically from about 100 to about 1000 cps at 25° C. which makes it quite desirable for use in jet dye injection apparatus. The Burns et al. application also discloses certain advantages associated with the use of para-toluene sulfonic acid as the primary or sole fiber degrading agent in such compositions.

Unfortunately, however, when the fiber degrading compositions of the type disclosed either by Boba or even more preferably Burns et al. are employed to sculpture wool fibers undesirable results may be achieved. For instance, the fiber degrading agent such as para-toluene sulfonic acid may penetrate to the base of the pile fibers and cause the entire pile fabric to be removed by subsequent mechanical means.

Accordingly, it would be highly desirable to provide a process for chemically sculpturing wool pile fibers where desirable and reproducible results may be achieved.

According to the present invention a process is provided for sculpturing a pile fabric having pile fibers made from wool, or wool-nylon blends, which comprises: treating said wool by oxidizing the cystine-disulfide bonds accompanied by acid hydrolysis; contacting the pile surface of said fabric with a fiber degrading composition, said composition comprising a fiber degrading agent in a concentration sufficient to reduce the tensile strength of the fibers of the pile in the selected areas so that said pile fibers may be removed by mechanical action; said fiber degrading agent being an aromatic sulfonic acid having a $pK_a$ value of less than about 2; said fiber degrading composition further containing a diluent for said fiber degrading agent, heating said pile fabric to a temperature sufficient f said pile tensile strength of said fibers o in the selected areas to be reduced sufficiently so that said fibers may be removed by mechanical means, but said temperature being low enough so as not to result in complete destruction of the fiber integrity prior to removal by mechanical means; and removing said degraded portion of said pile fibers by mechanical means to provide a sculptured pile fabric.

The pile fabrics which may be sculptured according to the present invention have pile fibers made entirely or substantially entirely of wool. The pile fabric may have a backing component made from wool or from other natural or synthetic fibers.

As mentioned above, according to the invention the wool is treated by oxidizing its cystine-disulfide bonds accompanied by acid hydrolysis. Wool is composed of a highly crosslinked mixture of proteins. It contains disulfide bonds also known as cystine crosslinks. It is believed that sculpturing may occur according to the present invention by first breaking the cystine-disulfide bonds, allowing the fiber degrading composition in a later step to penetrate to the fiber interior whereby the desired effect may be achieved. The irreversible oxidation and hydrolysis whereby cystine is converted to cysteic acid may be represented by the following formula:

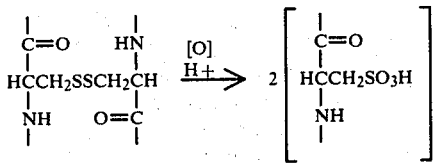

Oxidizing agents which may be employed as a treatment solution in the process of the present invention include chlorine, hydrogen peroxide, performic and peracetic acid, potassium permanganate, persulfate and permonosulfuric acid, although peracetic acid is the most preferred oxidizing agent because of its high selectivity for disulfide bond breakage. Also it has been found that less strength loss may result after treatment of wool with peracetic acid. In general the amount of oxidizing agent provided in the treatment solution may be from about 0.01 to about 10 percent by weight, preferably about 0.1 to about 2 percent by weight.

The treatment solution to treated fabric ratio may be from about 5:1 to about 100:1, preferably about 10:1 to about 50:1 by weight.

The temperature of the treatment solution may desirably be from about 15° C. to about 70° C., preferably from about 25° C. to about 60° C. Higher temperatures may result in yellowing of the wool. Lower temperatures may require undesirably long reaction time.

After treating the wool pile fibers as discussed above, the fiber degrading composition is applied to the pile fibers in order to produce the desired sculptured effect. The fiber degrading composition contains a fiber degrading agent as the primary active component of the composition. For purposes of this invention, the term "fiber degrading composition" may be defined as any active chemical compound or composition which when applied to the pile fabric causes the portion of the pile to which it has been applied to become brittle or to result in substantial reduction of the tensile strength of the portion of the fiber to which it is applied without actually dissolving the fiber so that the degraded portion of the pile can be removed at a later stage in the process by mechanical means.

Thus, it will be understood that as compared to prior known techniques for creating a sculptured or embossed effect on pile fabrics such as those disclosed in U.S. Pat. Nos. 3,849,157 and 3,849,158, the composition applied pursuant to the present invention in fact results in reducing the tensile strength of the fibers of the pile or portion of the pile to which it comes in contact but by contrast to the teachings of those references, does not result in any substantial shrinkage of the pile which, according to the present invention, is not desired. By contrast to those references which disclose dissolution of the pile, the fiber degrading composition is not a solvent for the pile fibers; that is, it does not remove the undesired fibers by simply dissolving them. The fiber degrading composition should be sufficiently active to result in reduction of the tensile strength of the desired areas and portion of the pile fabric while at the same time it should not be so active as to completely destroy or remove the desired area and portion of the pile prior to subsequent processing as will be fully described herein. The composition should be capable of being substantially removed or at least inactivated subsequent to the sculpturing steps. Other characteristics of the sculpturing composition which are desirable include compatibility with various dyes, thickeners, capability of being regulated by factors of time, temperature, and concentration; i.e., susceptibility to activation by heating, for instance by conventional steaming operation, and exhibiting no residual sculpturing activity.

The fiber degrading composition which is applied to the pile fibers to obtain the desired sculptured effect contains a fiber degrading agent for the pile of the fabric. The fiber degrading agent should be present in the composition in a concentration sufficient to reduce the tensile strength of the fibers so that the fibers may be removed after the application of heat by mechanical means. The concentration of the sculpturing agent should not be so high as to result in complete destruction of the fiber integrity prior to subsequent removal thereof by mechanical means. It has been found that the fiber degrading agent may preferably be present in the fiber degrading composition in an amount of from about 10 percent to 70 percent, preferably from about 20 percent to 50 percent by weight based upon the weight of the fiber degrading composition.

The fiber degrading agents useful in the process of the present invention include aromatic sulfonic acids having a $pK_a$ value of less than about 2, preferably from about −2 to about 1. Examples of suitable fiber degrading agents include benzene sulfonic acid, naphthalenesulfonic acid, ortho-, meta-, and para-toluenesulfonic acids, alkylated aromatic sulfonic acids wherein the alkyl group may be straight chain or branched chain and may contain from one to about 20 carbon atoms. Dodecylbenzene sulfonic acid is an example of a preferred alkylated aromatic sulfonic acid.

The fiber degrading agent is present in the fiber degrading composition together with a suitable diluent. The diluent may be a solvent for the fiber degrading agent, or alternatively if the agent is not soluble it should be present in the composition in a finely divided form, that is, it should be present in a micropulverized form which indicates particle diameter in the order of 100 microns or smaller, preferably even 20 microns or smaller. Such dispersion will assure that the agent becomes universally dispersed over the fiber during the process in the desired areas so that the degrading effect will be uniformly developed on the desired portions or all of the fiber. The fiber degrading composition may preferably include predominant amounts of water as a solvent for the fiber degrading agent, although other solvents, e.g., water, including methanol and ethanol may be employed.

The composition may further include a thickening agent, e.g., natural and synthetic gums and cellulose derivatives, by means of which the viscosity of the composition may be varied in a manner well known in the art in order to obtain the viscosity characteristics demanded in print technology and to enable the fiber degrading agent to adhere to and operate on the fiber and to hold the printed patterns. In general the viscosity of the composition may preferably be from about 100 to about 1000 cps, at 25° C., as measured by a Brookfield LVT No. 3 spindle at 30 rpm.

The fiber degrading composition may be applied to the pile fabric in an amount of from about 50 percent to 500 percent, preferably 150 percent to 250 percent, by weight based upon the weight of the area of substrate to be sculptured. The fiber degrading composition may be applied to the pile fabric in the form of a substantially transparent composition so that the only alteration of the product is the sculpturing effect. Alternatively, the fiber degrading composition may be part of a dye or pigment composition used in printing the fabric so that the color appears in perfect register where the fiber degrading composition has been selectively applied. The dye or pigment may generally be in the form of a printing paste ink to which the appropriate amount of agent is added. In preparing such modified dye compositions, viscosities, and dye concentration which are essential to an efficient dyeing operation must also be controlled. The resultant effect is in embossed design in register with the printed pattern with color in the printed areas.

With regard to the selected areas where the fiber degrading agent has been applied, the extent of pile removal and hence the depth of sculpturing may be controlled by varying the amount of fiber degrading composition applied or by varying the concentration of fiber degrading agent in the fiber degrading composition, or both. Furthermore, the amount of pile removed in the selected areas can also be controlled to a certain extent by the depth of penetration of the composition containing the fiber degrading agent into the pile of the fabric. Penetration can be controlled by varying, for instance, the viscosity of the chemical fiber degrading composition.

Application of the fiber degrading composition to the pile fabric may be accomplished by utilizing one of the many types of known printing apparatus thereby eliminating the need for expensive embossing or sculpturing equipment. Furthermore, it allows the sculpturing of a surface without exerting such pressure on the pile to result in permanent deformation of the fabric pile. In addition, because the sculpturing results from the removal of portions of the pile rather than by shrinkage of the pile in selected areas, the product typically has a much softer hand than would otherwise be provided for a given depth of sculpturing; and, also, exhibits all the advantages of products made by range printing techniques as opposed to woven fabric or hand sculptured fabric. The preferred apparatus for application of the fiber degrading composition may be a jet dyeing apparatus such as that disclosed in U.S. Pat. No. 4,084,615 to Norman E. Klein and William H. Stewart, assigned to Milliken Research Corporation, the disclosure of which is hereby incorporated herein by reference.

After the fiber degrading composition has been applied to the pile fabric, the fabric is heated to a temperature sufficient to cause a substantial reduction of the tensile strength of the fibers, generally temperatures of from about 120° F. to about 250° F. may be employed. Steam may be conveniently used for this purpose, and if it is desired to employ elevated temperatures above 212° F. in steaming, superheated steam or pressurized steam may be used.

Generally, the pile fabric may be subjected to heating for a time sufficient to cause degradation of the selected portions of the pile fabric. Where the heating means is steam, it has been found that heating should be for at least one minute, preferably about three to 30 minutes. The time of heating and the temperature of the atmosphere should be adjusted to result in the desired degree of degradation for the particular fiber substrate. Thus, if the temperature is too low or if the time of treatment is too short, insufficient degradation will occur to allow for subsequent removal of the pile by mechanical means. If the temperature is too high, both the pile and the fiber degrading agent may completely decompose (rather than degrade, e.g., partially hydrolyze) which will result in an undesirable product having an unpleasant hand in the embossed areas.

After steaming the pile fabric may be washed, preferably with water, to remove any residual components of the fiber degrading composition from the pile fabric. It has been found that the wash water should preferably be maintained at a temperature of from about 0° C. to about 40° C., preferably about 10° C. to about 30° C., although other temperatures may be employed. After washing the fabric may be dried by conventional means.

As mentioned above, the selected areas of the pile fabric to which the pile degrading agent has been applied may be removed by mechanical means. Mechanical action to cause such removal may be initiated or even be accomplished totally during the washing step described above by simply spraying the washing solution onto the entire surface of the substrate at a high velocity. Alternatively, the mechanical means by which the degraded portions are removed may be a simple beater which applies such action to the entire surface of the fabric from which degraded fabrics are to be removed. In general, the degree of mechanical action will depend upon the resultant tensile strength of the fiber after degradation in the areas to be sculptured. Mechanical removal of the degraded pile may be performed during the washing step as mentioned above or alternatively after washing but prior to drying or even after drying of the fabric.

A large number of products can be produced by the process of the present invention. The products can be used for floor, wall and ceiling coverings, drapery, upholstery and the like, and, in fact wherever pile fabrics are utilized. They are readily adaptable to decorating any surface on which pile fabrics can be applied. Many additional applications will occur to those skilled in the art.

The following examples are provided for illustrative purposes only and are not to be construed as limiting the subject matter of the invention in any way. Unless otherwise indicated, all parts and percentages are by weight.

EXAMPLE 1

In this example the process was performed on 100 percent New Zealand wool (average staple length of 2.52 inches and an average fiber cross-sectional area of $1.62\times10^{-5}$ cm2) and spun into a single-ply yarn. The wool yarn was in the form of a tufted carpet with a 1/10 inch tufting gauge at 14.5 tufting stitches per inch, pile height of 35/64 inch, 50.01 ounces per square yard face weight and tufted into a nonwoven polypropylene back.

The wool carpet was first treated with an oxidation composition containing 0.42 percent by weight peracetic acid and 0.78 percent by weight glacial acetic acid. The peracetic acid is available as a 35 percent by weight reaction product in glacial acetic acid. The remainder of the oxidation composition was water present as a diluent. The oxidation composition was loaded into a standard beck dyeing apparatus at a 20:1 oxidation-composition to wool-carpet-face-weight ratio. The wool carpet was sewn onto the beck winch and the winch started. The oxidation composition was then heated to a constant 50° C. with steam injection, after which the wool carpet was treated for a period of 30 minutes. The remaining oxidation composition was then drained and the wool carpet was washed with water for 10 minutes, three successive times at approximately 70° F. to remove any unreacted peracetic acid and glacial acetic acid. The wool carpet was removed from the beck dyeing apparatus and dried in a conventional hot air dryer at 230° F.

The second processing step involved the use of a fiber degrading composition which contained 35 percent by weight paratoluene sulfonic acid, 0.5 percent by weight xanthan gum, 2 percent by weight mineral oil called ortholube 100 available from Milliken Chemical, a Division of Milliken & Company, and 0.185 percent acid dye. The remainder of the composition was water present as a diluent.

The wool carpet was wetted to approximately 80 percent wet pickup based on the wool carpet face weight with an aqueous solution of xanthan gum to enhance the levelness of coexisting dyeing of the wool carpet. The fiber degrading composition and applied on preselected areas of the fabric at approximately 185 percent wet pickup based on the face weight of the selected areas of the wool carpet. Application of the composition was by means of the apparatus described in U.S. Pat. No. 4,084,615. The fabric was then steamed at approximately 212° F. for ten minutes to activate the reaction between the wool fiber and the sculpturing liquor and to fix the dye. It was then washed with water at a temperature of about 70° F. to remove any chemicals and thickening agents present on the wool carpet and then dried at 230° F. in a conventional hot air dryer. Prior to the final carpet finishing operation the wool carpet was first subjected to a mechanical beating action over the entire fabric surface and then vacuumed to remove the degraded wool fibers.

During and after the process the following observations were made:

(1) After treatment with the oxidation composition the wool carpet showed no visual damage.

(2) Analysis of the remaining oxidation composition after its treatment to the wool carpet proved that near complete exhaustion of the peracetic acid had taken place.

(3) There was no reduction in carpet pile height in the areas treated with the fiber degrading composition or weight loss observed prior to steaming.

(4) A reduction of about 15 to 25 percent in pile height in the sculptured areas was noticed after steaming. These areas appeared to have shrunken during steaming and the fiber tensile strength was dramatically reduced.

(5) After drying and subsequent mechanical face beating, the wool carpet pile height in the sculptured areas was reduced approximately 60 to 70 percent.

(6) The remaining yarn in the sculptured areas maintained fiber integrity and had substantially the same hand characteristics as the untreated yarns of the pile carpet.

EXAMPLE 2

Example 1 was repeated except that the concentration of peracetic acid and glacial acetic acid in the oxidation composition was increased from 0.42 percent and 0.78 percent to 0.45 and 0.84 weight percent respectively. Yellowing of the wool carpet was observed during the oxidation process, but the wool fibers in the sculptured areas after the fiber degrading process were more easily removed.

EXAMPLE 3

Example 1 was repeated except that the concentration of peracetic acid and glacial acetic acid in the oxidation composition was decreased from 0.42 percent and 0.78 percent to 0.35 and 0.65 weight percent respectively. The wool fibers retained enough tensile strength after the fiber degrading process to severely limit subsequent removal, resulting in unacceptable sculptured areas.

EXAMPLE 4

Example 1 was repeated except that the fabric was an 80 percent New Zealand wool, 20 percent nylon 66 (single ply), 1/10 gauge, 15.6 stitches per inch, 21/64 inch pile height, 34 ounces per square yard, face weight, tufted into a nonwoven polypropylene backing. In addition, the concentration of peracetic acid glacial and acetic acid in the oxidation composition was decreased from 0.42 and 0.78 weight percent to a 0.385 and 0.715 respectively. The fabric showed no visual damage after the oxidation process. The nylon fibers were severely degraded after the fiber degrading process and the remaining wool fibers were easily removed.

EXAMPLE 5

Example 1 was repeated except that the oxidation composition contained 5.0 weight percent potassium peroxymonosulfate purchased under the Trademark Ozone from DuPont rather than peracetic acid and glacial acetic acid. An unacceptable yellowing of the wool occured during the oxidation process, but the wool fibers in the sculptured areas after the fiber degrading process lost sufficient tensile strength to be removed.

EXAMPLE 6

Example 1 was repeated except that the oxidation composition contained 3.0 weight percent hydrogen peroxide rather than peracetic acid and glacial acetic acid. Yellowing of the wool which occurred during the oxidation process was observed. Also, a slight shrinkage of the pile fabric was observed. The wool fibers in the sculptured areas after degrading process were easily removed.

EXAMPLE 7

Example 1 was repeated except that the para-toluenesulfonic acid concentration was increased from 35 weight percent to 45 weight percent. After the fiber degrading process little or no tensile strength loss was observed at the top of the pile but total degradation of the wool occurred at the base of the pile nearest the carpet backing. Microscopic observations showed considerable shrinkage in the tops of the pile fabric. Subsequent mechanical beating cleaved the pile at the carpet backing, removing all of the pile.

EXAMPLE 8

Example 1 was repeated except that the fabric was not wetted prior to the application of the fiber degrading composition. The wool fibers produced a fine powder after minimal mechanical beating and consequently, they were much easier to remove.

What is claimed is:

1. A process for sculpturing a pile fabric having pile fibers made from wool, or wool-nylon blends, which comprises: treating said wool by oxidizing its disulfide bonds accompanied by acid hydrolysis; contacting the pile surface of said fabric with a fiber degrading composition, said composition comprising a fiber degrading agent in a concentration sufficient to reduce the tensile strength of the fibers of the pile in the selected areas so that said pile fibers may be removed by mechanical action; said fiber degrading agent being an aromatic sulfonic acid having a $pK_a$ value of less than about 2; said fiber degrading composition further containing a diluent for said fiber degrading agent, heating said pile fabric to a temperature sufficient to cause the tensile strength of said fibers of said pile in the selected areas to be reduced sufficiently so that said fibers may be removed by mechanical means, but said temperature being low enough so as not to result in complete destruction of the fiber integrity prior to removal by mechanical means; and removing said degraded portion of said pile fibers by mechanical means to provide a sculptured pile fabric.

2. The process of claim 1 wherein the disulfide bonds of said wool are oxidized by means of an oxidizing agent selected from chlorine, hydrogen peroxide, performic and peracetic acid, potassium permanganete, persulfate, and permonosulfuric acid.

3. The process of claim 2 wherein said oxidizing agent is a peracetic acid.

* * * * *

UNITED STATES PATENT AND TRADEMARK OFFICE

CERTIFICATE OF CORRECTION

PATENT NO. : 4,415,331

DATED : November 15, 1983

INVENTOR(S) : Joseph H. Dusenbury et al.

It is certified that error appears in the above-identified patent and that said Letters Patent is hereby corrected as shown below:

Column 1, line 54, delete the word "acylic" and insert therefor --acrylic--.

Column 3, line 5, after the word "sufficient" delete "f" and insert therefor --to cause the tensile strength of said fibers of--.

Column 3, line 6, delete the words "tensile strength of said fibers o"

Column 7, line 49, after "composition" delete the word "and" and insert therefor --was--.

Signed and Sealed this

*Fifth* Day of *March 1985*

[SEAL]

*Attest:*

DONALD J. QUIGG

*Attesting Officer* *Acting Commissioner of Patents and Trademarks*